US008872052B2

(12) United States Patent
Zak

(10) Patent No.: US 8,872,052 B2
(45) Date of Patent: Oct. 28, 2014

(54) JUMPER WITH INTEGRATED SWITCH

(76) Inventor: Juan Zak, Roskilde (DK)

( * ) Notice: Subject to any disclaimer, the term of this patent is extended or adjusted under 35 U.S.C. 154(b) by 820 days.

(21) Appl. No.: 12/108,454

(22) Filed: Apr. 23, 2008

(65) Prior Publication Data

US 2009/0223802 A1 Sep. 10, 2009

Related U.S. Application Data

(60) Provisional application No. 61/034,105, filed on Mar. 5, 2008.

(51) Int. Cl.
*H01H 13/12* (2006.01)
*H01H 13/52* (2006.01)
*H01H 1/20* (2006.01)

(52) U.S. Cl.
CPC . *H01H 13/52* (2013.01); *H01H 1/20* (2013.01)
USPC ..... 200/529

(58) Field of Classification Search
CPC ..... H01H 13/52; H01H 1/221
USPC ..... 200/534, 244, 281, 552, 557, 529, 8 A, 200/520, 521, 530, 532, 535, 537; 439/507, 439/508, 510, 512, 514; 361/828, 832, 837
See application file for complete search history.

(56) References Cited

U.S. PATENT DOCUMENTS

| | | | | | |
|---|---|---|---|---|---|
| 3,275,766 | A | * | 9/1966 | Krehbiel | 200/51 R |
| 3,731,030 | A | * | 5/1973 | Holzer | 200/529 |
| 3,931,487 | A | * | 1/1976 | Russenberger | 200/529 |
| 4,052,580 | A | * | 10/1977 | Stanish | 200/535 |
| 5,749,458 | A | | 5/1998 | Bianca | |

FOREIGN PATENT DOCUMENTS

| | | | | | |
|---|---|---|---|---|---|
| JP | 06000242 | A | * | 1/1994 | A63F 7/02 |

* cited by examiner

*Primary Examiner* — F O Figueroa

(57) ABSTRACT

This novel jumper features an integrated mechanical switch that allows resetting the CMOS memory of computer motherboards just by actuating a reset button on the jumper, instead of moving a prior-art jumper back and forth over the CMOS-reset block. The disclosed jumper can also be adapted for use as temporary button for powering on, restarting and resetting motherboards when tested alone; in this case the jumper just needs to be inserted over the corresponding pair of pins on the front-panel header of the motherboard. This jumper is also applicable to other electric or electronic devices where operating the jumper's integrated switch is more convenient or safer than moving prior-art jumpers or manually shorting up pins on printed circuit boards.

10 Claims, 7 Drawing Sheets

JUMPER WITH INTEGRATED SWITCH

RELATED APPLICATIONS

This application claims the priority date of U.S. Provisional Application Ser. No. 61/034,105 filed Mar. 5, 2008.

BACKGROUND OF THE INVENTION

1. Field of the Invention

This invention comprises a jumper with integrated switch for use in computer motherboards and other electric or electronic devices where jumpers and jumper blocks (or headers) mounted on printed circuit boards are used to configure said devices. The mechanical switch integrated in this novel jumper allows configuring, starting or resetting the devices just by actuating said switch, instead of the prior-art method of moving jumpers back and forth, or manually shorting up pins on blocks or headers by interposing metallic objects.

2. Description of the Prior Art

Prior-art jumpers generally consist of a metallic sheet with sleeves which slip tightly over two neighboring pins on a jumper block (also called header) mounted on the surface of the printed circuit board. In this way the metallic sheet of the jumper provides physical and electrical connection between the corresponding pins of the block or header. The metallic sheet is encapsulated in a non-conductive plastic housing.

Computer motherboards store configuration values in CMOS memory. A prior-art jumper and a 3-pin jumper block (CMOS-reset block) are typically used to either keep the current configuration or restore the default configuration. Keeping the current configuration just requires leaving the jumper inserted over pins 1 and 2 of the CMOS-reset block. Resetting the configuration requires removing the jumper from pins 1 and 2 of the block, inserting said jumper over pins 2 and 3 for few seconds, and putting the jumper back over pins 1 and 2.

Resetting the CMOS configuration may become a frequent procedure for hardware technicians during certain troubleshooting events, or for computer enthusiasts during overclocking experiments. In these cases, the above described procedure of moving the jumper to pins 2 and 3 of the CMOS-reset block, and then back to pins 1 and 2, becomes time consuming and irritating, especially when the motherboard is already mounted inside the computer case.

Other annoying procedures for hardware technicians and computer enthusiasts are powering on, restarting and resetting the motherboard when tested outside of the computer case. The reason is that said powering on, restarting and resetting are normally executed via switches mounted on the computer case, which in this test situation must be disconnected from the motherboard. The usual practice is to manually interpose a metallic object (e.g. a screwdriver) between the corresponding pins on the motherboard's front-panel header; besides being annoying, such practice requires great care to avoid damages to other components on the motherboard by accidental electrical shorts.

BRIEF SUMMARY OF THE INVENTION

The present invention discloses a novel jumper with an integrated mechanical switch that allows resetting the CMOS memory of computer motherboards just by actuating a reset button on the jumper, instead of moving the usual prior-art jumper back and forth over the CMOS-reset block. This novel jumper can also be provided with wiring as to allow taking said reset button out of the computer case; optionally, the CMOS reset button can be mounted on the front panel of the computer case or on an I/O bracket at the rear of the computer.

The disclosed jumper can also be adapted for use as temporary switch for powering on, restarting and resetting the motherboard when tested alone. In this application, the jumper just needs to be inserted over the corresponding pair of pins (power or reset) on the front-panel header of the motherboard.

This novel jumper is also applicable to other electric or electronic devices where operating the jumper's integrated switch is more convenient or safer than moving prior-art jumpers or manually shorting up pins on printed circuit boards.

DETAILED DESCRIPTION OF PREFERRED EMBODIMENTS

The following description of the jumper with integrated switch disclosed herein includes many details that should not be considered as limitations of this invention, but rather as examples of a number of possible variations. Thus, the scope of the present invention should be determined by the appended claims and their legal equivalents, and not only by the below described embodiments.

Figure 1:
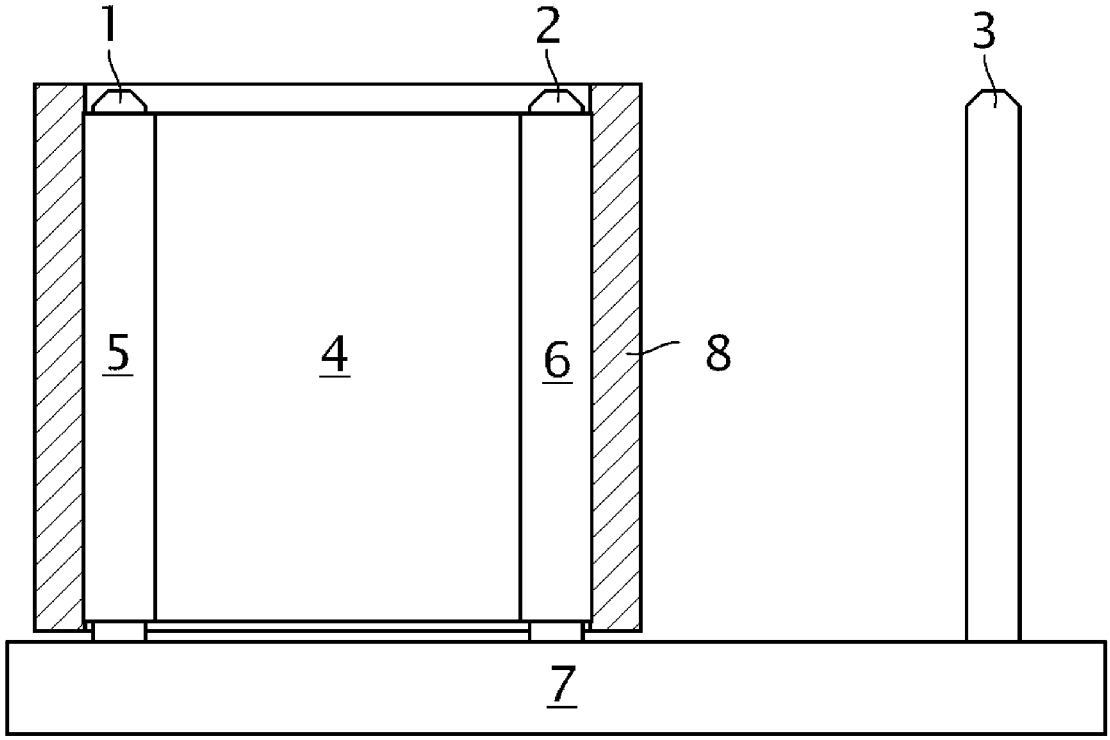
FIG. 1: Sectional front view of a typical prior-art jumper mounted on the CMOS-reset block of a computer motherboard.

FIG. 1 illustrates a typical prior-art jumper mounted on the CMOS-reset block of a computer motherboard; metallic sheet 4 with sleeves 5 and 6 is mounted on pins 1 and 2 of CMOS-reset block 7; metallic sheet 4 and sleeves 5 and 6 are embedded in non-conductive housing 8.

The jumper disclosed herein has a built-in mechanical switch. This novel jumper consists of one independent sleeve for each block pin. Each said sleeve provides a contact area for a metallic jumper element. Said jumper element is actuated by a button to connect/disconnect predetermined pins of the jumper block. A spring keeps the jumper element in the desired default position when the actuating button is released. Said sleeves are embedded in a non-conductive housing, which also provides support and enclosure for said jumper element, spring and actuating button.

Figure 2:
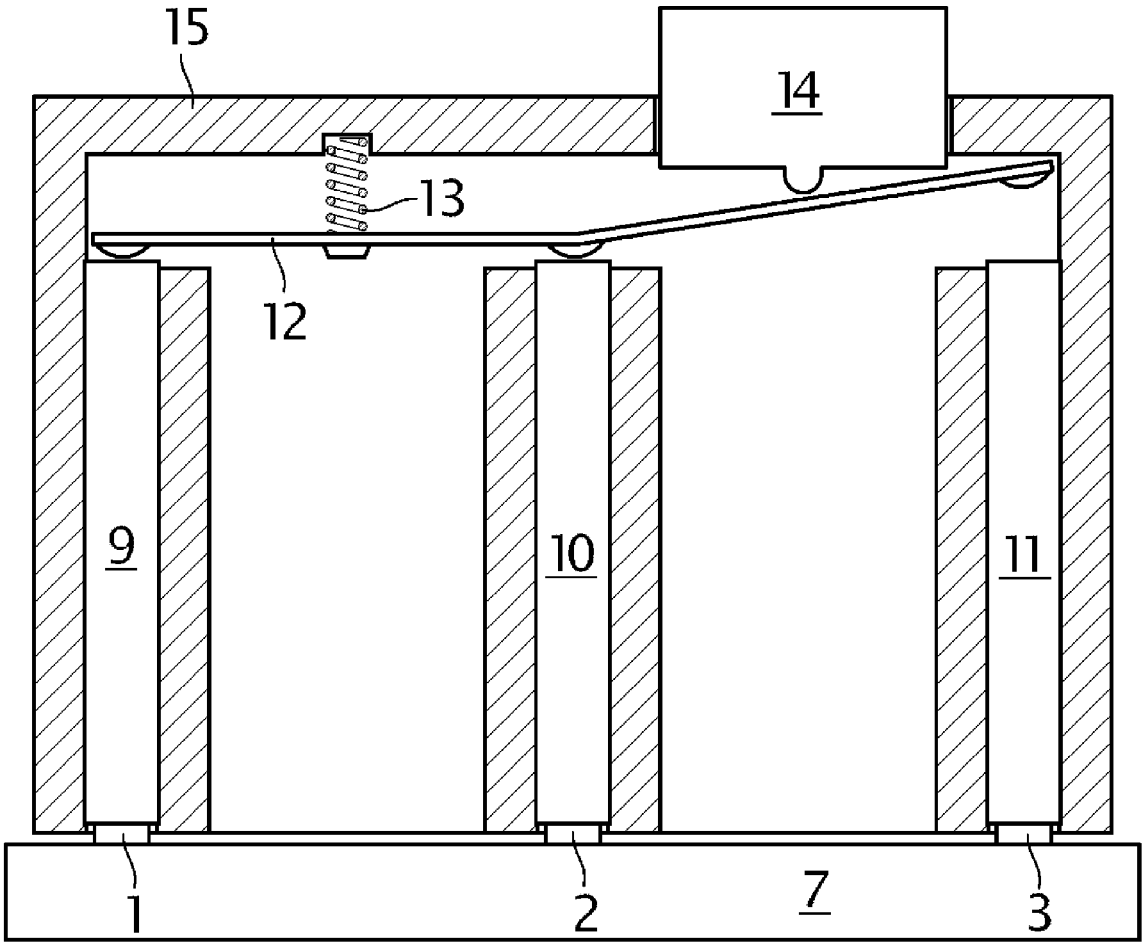
FIG. 2: Sectional front view of the jumper with integrated switch, mounted on the CMOS-reset block of a computer motherboard; the reset button and the jumper element are shown in the released position (pins 1 and 2 of the CMOS-reset block in the normally shorted position)

FIG. 2 shows one possible implementation of the jumper with integrated switch for the CMOS-reset block of a computer motherboard. Metallic sleeves 9, 10 and 11 are mounted on pins 1, 2 and 3 of CMOS-reset block 7. Metallic jumper element 12 pivots over sleeve 10. Spring 13 keeps jumper element 12 against sleeves 9 and 10; therefore jumper element 12 maintains pin 1 and 2 normally shorted, just like a prior-art jumper in the default position.

Figure 3:
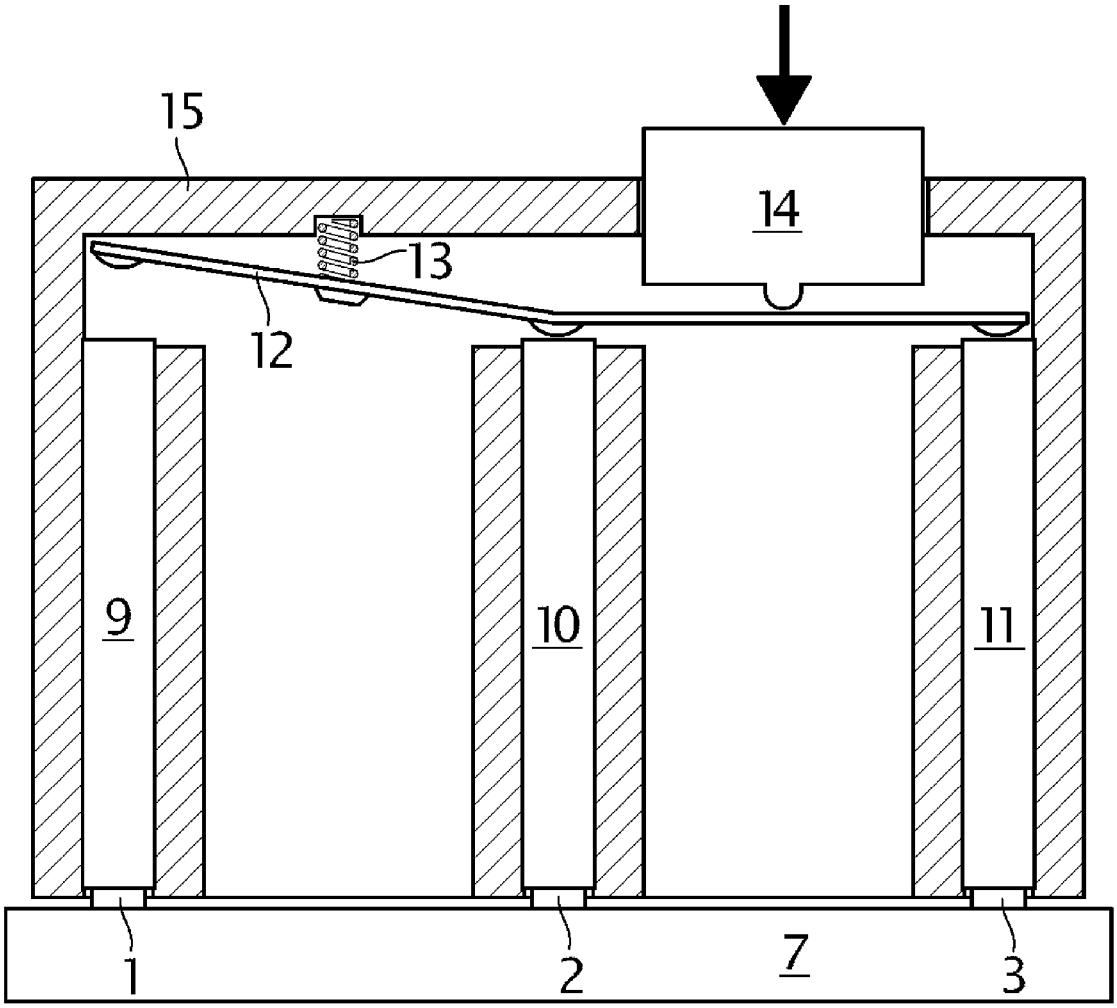
FIG. 3: Sectional front view of the jumper with integrated switch, mounted on the CMOS-reset block of a computer motherboard; the reset button and the jumper element are shown in the actuated position (pins 2 and 3 of the CMOS-reset block in the shorted position)

Pushing reset button 14 causes jumper element 12 to pivot over sleeve 10 against sleeve 11 (FIG. 3). Therefore contact between pins 1 and 2 is interrupted, while contact between pins 2 and 3 is established, just like a prior-art jumper does when moved to the reset position. Releasing button 14 will allow spring 13 to move jumper element 12 back against sleeve 9, thus reestablishing the connection between pins 1 and 2. The sleeves, jumper element, spring and button are contained in non-conductive housing 15.

Figure 4:
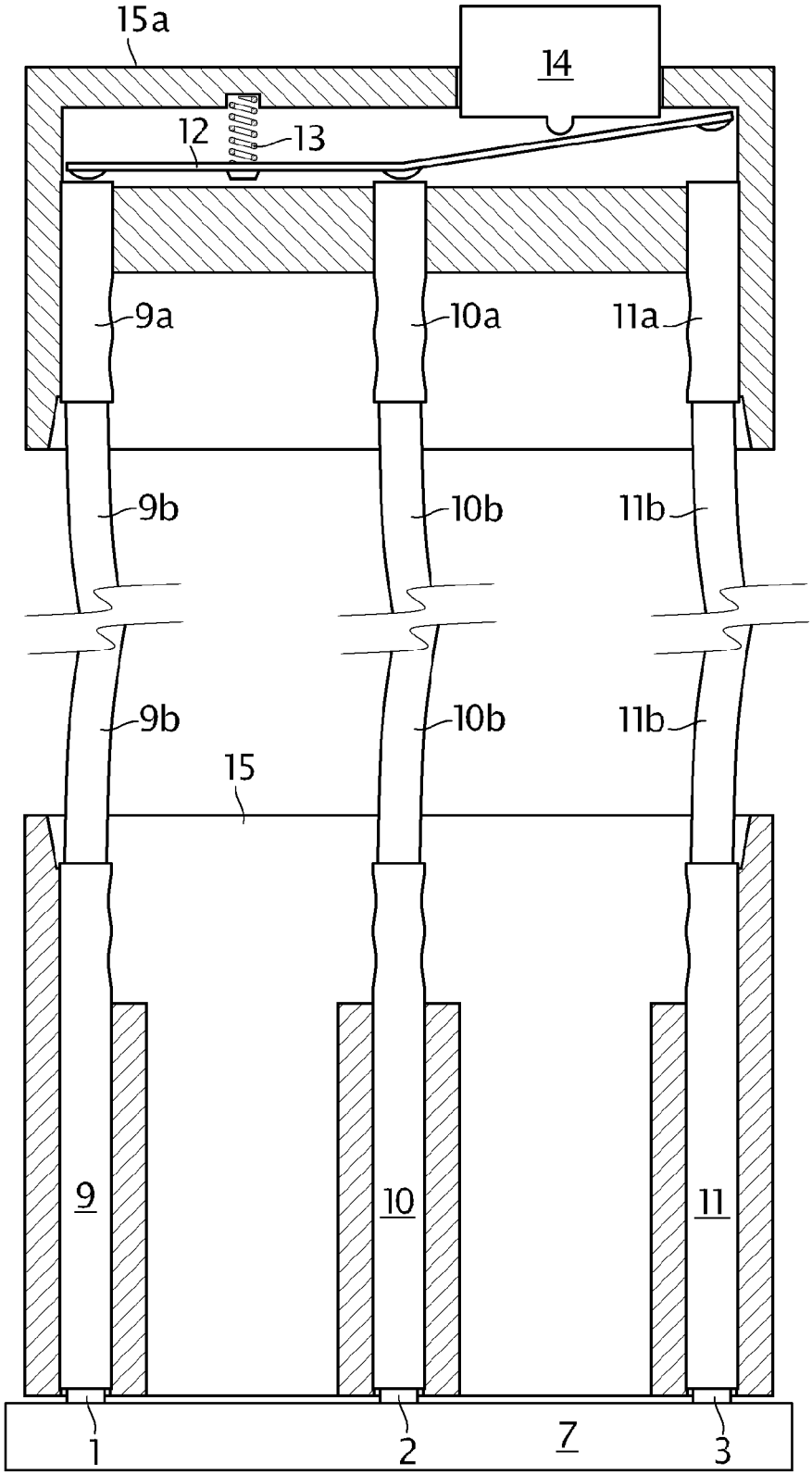
FIG. 4: Sectional front view of the jumper with integrated switch, where said switch is installed on a separate housing and connected to the jumper housing via electrical wires.
Figure 6:
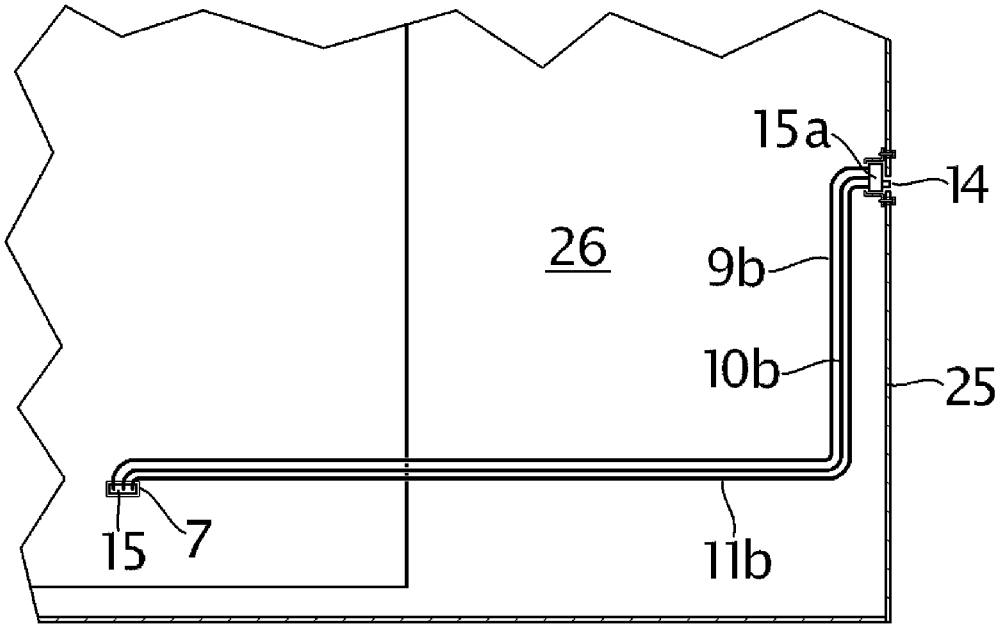
FIG. 6: Sectional view of a computer case featuring the jumper with integrated switch where said jumper is mounted on the CMOS-reset block of the computer motherboard, said switch is mounted on the front panel of the computer case, and electrical wires interconnect the jumper and the switch.
Figure 7:
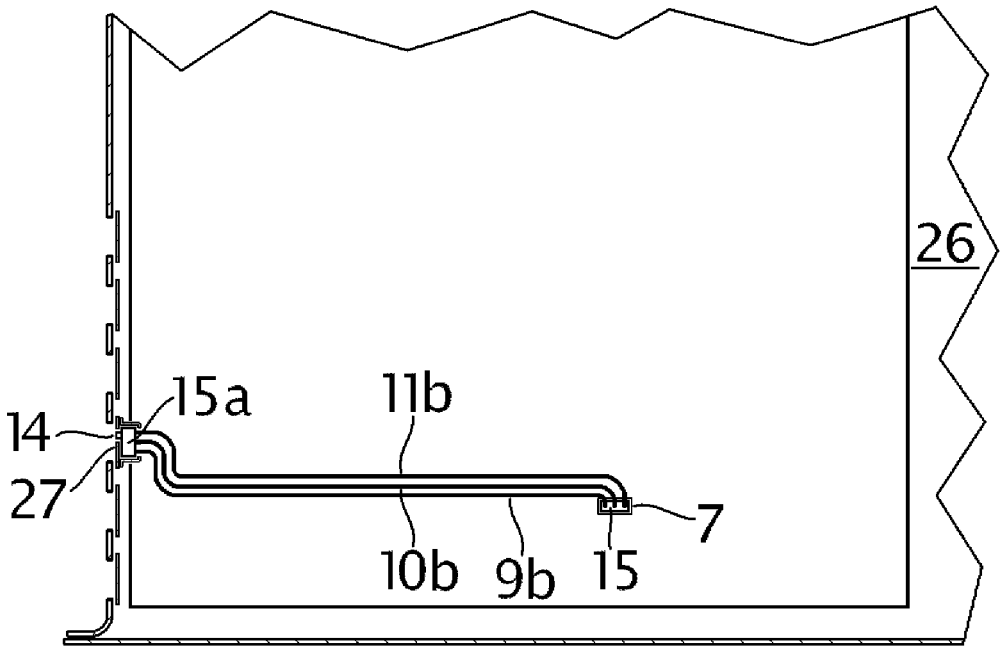
FIG. 7: Sectional view of a computer case featuring the jumper with integrated switch where said jumper is mounted on the CMOS-reset block of the computer motherboard, said switch is mounted on an I/O bracket at the rear of the computer case, and electrical wires interconnect the jumper and the switch.

As shown in FIG. 4, reset button 14, jumper element 12, spring 13, and sleeves 9*a*, 10*a* and 11*a* can be embedded in housing 15*a*, separate from jumper housing 15. Sleeves 9*a*, 10*a* and 11*a* are connected to sleeves 9, 10 and 11 in jumper housing 15 via electric wires 9*b*, 10*b* and 11*b*. In this way, CMOS reset button 14 can be actuated from outside of the computer case. Optionally, the CMOS reset button can be mounted on the computer case, for example on front panel 25 of computer case 26 (FIG. 6), or on an I/O bracket 27 at the rear of said computer case (FIG.7). Means for electrically insulating and securing the ends of said wires to respectively said switch housing and jumper housing are not shown in FIG. 4.

Figure 5:
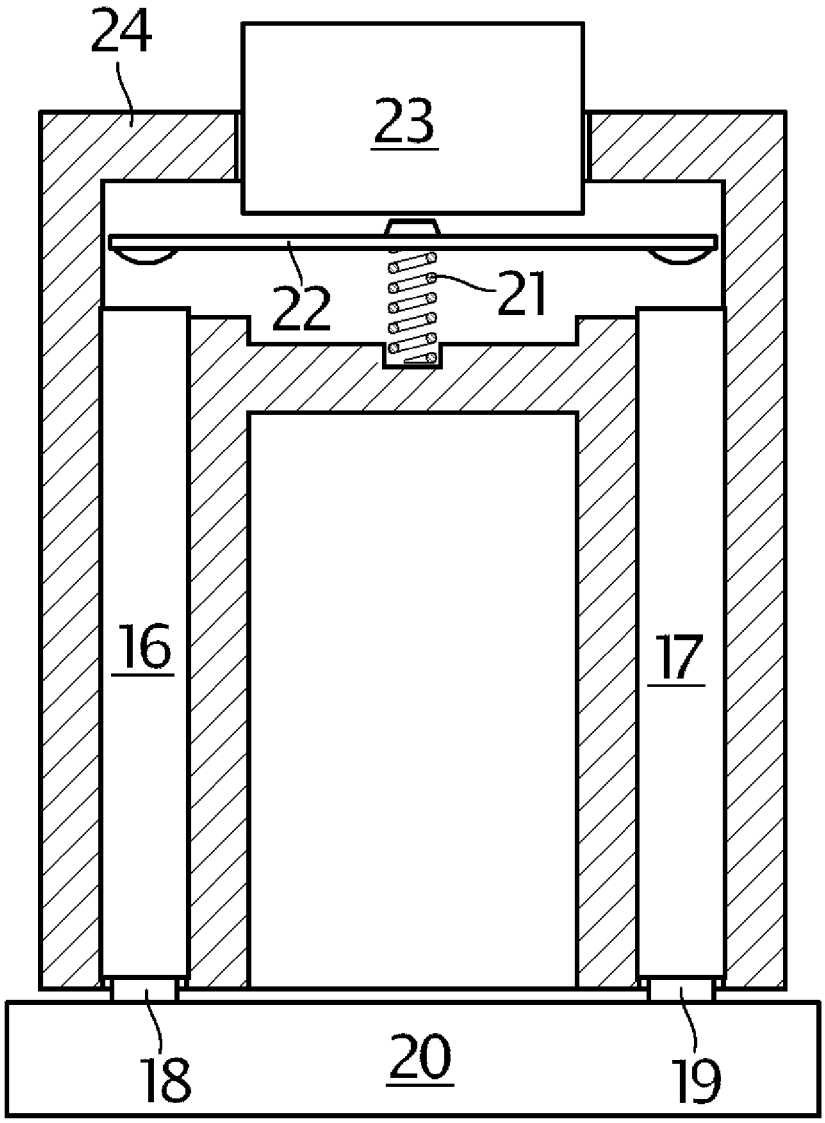
FIG. 5: Sectional front view of the jumper with integrated switch, mounted on two contiguous pins of the front-panel header of a computer motherboard; the switch button and the jumper element are shown in the released position (pins 18 and 19 of the front-panel header in the normally non-shorted position).

FIG. 5 illustrates one possible implementation of the jumper with integrated switch for temporary operation as power or reset switch on the front-panel header of a computer motherboard. In this case only two sleeves are needed. Sleeves 16 and 17 are mounted on pins 18 and 19 of front-panel header 20. Spring 21 keeps jumper element 22 away from sleeves 16 and 17. Pushing button 23 will move jumper element 22 against sleeves 16 and 17, thus establishing contact between pins 18 and 19, in the same way as the standard power or reset switch mounted on the computer case does. Releasing button 23 will allow spring 21 to move jumper element 22 away from sleeves 16 and 17, thus interrupting contact between pins 18 and 19, just like the standard power or reset switch on the computer case does. Said sleeves, jumper element, spring and button are contained in non-conductive housing 24.

The above examples are just some of the possible implementations of the jumper with integrated switch. The number of pin sleeves, jumper elements, buttons and switch positions can be adjusted to fit any particular need in a variety of electric or electronic devices where jumpers are used for configuration or pins are manually shorted up for resetting, starting or restarting the device.

What is claimed is:

1. A jumper for keeping current configuration values or restoring default configuration values in the CMOS memory of computer motherboards, said jumper comprising:

a) three independent generally cylindrical sleeves to be slipped over respectively the first, second and third pin of the CMOS-reset block of a computer motherboard; every said sleeve providing a suitable contact area for adequate electrical connection;

b) a metallic jumper element that electrically interconnects said sleeves via said contact areas; said jumper element being shaped such that only the first and second of said sleeves, or only the second and third of said sleeves, are interconnected at the same time; said jumper element having as well suitable contact areas for adequate electrical connection with said sleeves, two of said contact areas being located close to each end of said jumper element, and the third of said contact areas being located midway between said first and second contact areas;

c) an electrically non-conductive housing that fixedly embeds said sleeves, and at the same time encloses said jumper element such that said element is only allowed to move as to interconnect either the first and second of said sleeves, or the second and third of said sleeves;

d) an elastic element mounted between said jumper element and said housing, said elastic element pushes against said jumper element through an area physically contacting and jumper element, and such that said elastic element simultaneously pushes against said housing through an area physically contacting said housing, said elastic element driving said jumper element to fully contact and thus interconnect said first and second sleeves; and, e) a reset button to manually actuate said jumper element against said elastic element, in order to break the electrical connection between the first and second of said sleeves, and make an electrical connection between the second and third of said sleeves; said reset button being mounted in said housing such that:

said button when fully released into a normally released position allows said elastic element to drive said jumper element against said first and second sleeves;

said button when fully actuated forces said jumper element to fully contact said second and third sleeves; and, said button when released is urged into and kept in said normally released position directly by said jumper element.

2. A method for restoring default configuration values in the CMOS memory of computer motherboards by using the jumper disclosed in claim 1, said jumper being mounted on the CMOS-reset block of the motherboard, said method consisting of the following steps:

a) performing the CMOS-reset preparatory procedure specifically applicable to said computer motherboard;

b) manually actuating said reset button on said jumper for the time period specified for said motherboard;

c) releasing said reset button; and, d) performing the CMOS-reset concluding procedure applicable to said motherboard.

3. A jumper for keeping current configuration values or restoring default configuration values in the CMOS memory of computer motherboards, said jumper comprising:

a) three independent generally cylindrical pin sleeves to be slipped over respectively the first, second and third pin of the CMOS-reset block of a computer motherboard; the upper end of every said pin sleeve being electrically connected to one end of a flexible electrical wire with insulating cover;

b) a first electrically non-conductive housing that fixedly embeds said pin sleeves, and at the same time secures and electrically insulates the end of said wires connected to said pin sleeves;

c) three independent generally cylindrical switch sleeves, each providing a suitable contact area for adequate electrical connection; the lower end of said switch sleeves being electrically connected to the other end of said wires such that said first, second and third switch sleeves are electrically connected through the corresponding wire to respectively the first, second and third pin sleeves of said first housing;

d) a metallic jumper element that electrically interconnects said switch sleeves via said contact areas; said jumper element being shaped such that only the first and second of said switch sleeves, or only the second and third of said switch sleeves, are interconnected at the same time; said jumper element having as well suitable contact areas for adequate electrical connection with said switch sleeves, two of said contact areas being located close to each end of said jumper element, and the third of said contact areas being located midway between said first and second contact areas;

e) a second electrically non-conductive housing that fixedly embeds said switch sleeves, and at the same time encloses said jumper element such that said element is only allowed to move as to interconnect either the first and second of said switch sleeves, or the second and third of said switch sleeves; said housing also securing and electrically insulating the end of said wires connected to said switch sleeves;

f) an elastic element mounted between said jumper element and said second housing, such that said elastic element pushes against said jumper element through an area physically contacting said jumper element, such that said elastic element simultaneously pushes against said second housing through an area physically contacting said second housing, said elastic element driving said jumper element to fully contact and thus interconnect said first and second switch sleeves; and, g) a reset button to manually actuate said jumper element against said elastic element, in order to break the electrical interconnection between the first and second of said switch sleeves, and make an electrical connection between the second and third of said switch sleeves; said reset button being mounted in said second housing such that:

said button when fully released into a normally released position allows said elastic element to drive said jumper element completely against said first and second switch sleeves;

said button when fully actuated forces said jumper element to fully contact said second and third switch sleeves; and, said button when released is urged into and kept in said normally released position directly by said jumper element.

4. A jumper for powering on, restarting or resetting a computer motherboard directly from the motherboard's front-panel header, said jumper comprising:

a) two independent generally cylindrical sleeves to be slipped over respectively the first and second power or reset pins of the front-panel header of said motherboard; every said sleeve providing a suitable contact area for adequate electrical connection;

b) a metallic jumper element that electrically interconnects said sleeves via said contact areas; said jumper element having as well suitable contact areas for adequate electrical connection with said sleeves, said contact areas being located close to each end of said jumper element;

c) an electrically non-conductive housing that fixedly embeds said sleeves, and at the same time encloses said jumper element such that said element is only allowed to move as to interconnect said sleeves;

d) an elastic element mounted between said jumper element and said housing, such that said elastic element pushes against said jumper element through an area physically contacting said jumper element, and such that said elastic element simultaneously pushes against said housing through an area physically contacting said housing, said elastic element keeping said jumper element away from said sleeves; and, e) a button to manually actuate said jumper element against said elastic element, in order to make an electrical connection between said sleeves; said button being mounted in said housing such that:

said button when fully released into a normally released position allows said elastic element to drive said jumper element completely away from said first and second sleeves;

said button when fully actuated forces said jumper element to fully contact said first and second sleeves; and, said button when released is urged into and kept in said normally released position directly by said jumper element.

5. A method for powering on or restarting a computer motherboard directly from the motherboard's front-panel header, which method consists of manually actuating the button on the jumper disclosed in claim 4, said jumper being mounted on the first and second power pins of said front-panel header.

6. A method for resetting a computer motherboard directly from said motherboard's front-panel header, which method consists of manually actuating the button on the jumper disclosed in claim 4, said jumper being mounted on the first and second reset pins of said front-panel header.

7. A jumper for modifying the configuration, powering on and resetting printed circuit boards, said jumper comprising:

a) a plurality of N independent generally cylindrical sleeves, each to be slipped over the respective pin in a plurality of N pins of a pin-header mounted on a printed circuit board; every said sleeve providing a suitable contact area for adequate electrical connection;

b) a number of metallic jumper elements that electrically interconnect different groups of said sleeves via said contact areas; each of said jumper elements interconnecting two or more of said sleeves as required; each of said jumper elements being shaped such that only the required number of said sleeves is interconnected at the same time when said jumper element is either released or actuated; every said jumper element having suitable contact areas for adequate electrical connection with the matching sleeves, said contact areas being properly located along said jumper element as to effectively contact the corresponding areas on the matching sleeves;

c) an electrically non-conductive housing that fixedly embeds said sleeves, and at the same time encloses said jumper elements such that every said element is only allowed to move as to interconnect just the required number of said sleeves at the same time when said jumper element is either released or actuated;

d) a number of elastic elements mounted between every said jumper element and said housing, such that every said elastic element pushes against the corresponding jumper element through an area physically contacting said corresponding jumper element, and such that every said elastic element simultaneously pushes against said housing through an area physically contacting said housing, every said elastic element driving the corresponding jumper element to fully contact and thus interconnect the required number of sleeves at the same time when said jumper element is in the released position;

e) a number of buttons to manually actuate said jumper elements against said elastic elements, in order to break the electrical connection between the required number of said sleeves, and make an electrical connection between the required number of said sleeves; every said button being mounted in said housing such that:

said button when fully released into a normally released position allows the corresponding elastic element to drive the matching jumper element completely against the required number of said sleeves;

said button when fully actuated forces the corresponding jumper element to fully contact and thus interconnect the required number of said sleeves; and, said button when released in urged into and kept in said normally released position directly by the corresponding jumper element.

8. A method for modifying the configuration, powering on and resetting printed circuit boards, which method consist of actuating and releasing the appropriate buttons on the jumper disclosed in claim 7, said jumper being mounted on the corresponding pin-header of a printed circuit board.

9. The jumper according to claim 3 wherein said second electrically non-conductive housing is mounted on the front panel of the computer case hosting said motherboard; said second housing embedding said switch sleeves, enclosing said jumper element, securing and insulating said wire ends, and supporting said elastic element and said reset button, as disclosed in claim 3.

10. The jumper according to claim 3 wherein said second electrically non-conductive housing is mounted on an I/O bracket in the rear of the computer case hosting said motherboard; said second housing embedding said switch sleeves, enclosing said jumper element, securing and insulating said wire ends, and supporting said elastic element and said reset button, as disclosed in claim 3.

* * * * *